US007395686B2

(12) United States Patent
Dervy et al.

(10) Patent No.: US 7,395,686 B2
(45) Date of Patent: Jul. 8, 2008

(54) BOTTOM PROFILE FOR DRAWN AND IRONED CAN BODY

(75) Inventors: Lillian Dervy, Glenview, IL (US); Michael R. Gogola, Arlington Heights, IL (US); William Walsh, Lombard, IL (US)

(73) Assignee: Rexam Beuerage Can Company, Chicago, IL (US)

( * ) Notice: Subject to any disclaimer, the term of this patent is extended or adjusted under 35 U.S.C. 154(b) by 0 days.

(21) Appl. No.: 11/890,107

(22) Filed: Aug. 2, 2007

(65) Prior Publication Data

US 2007/0274807 A1 Nov. 29, 2007

Related U.S. Application Data

(62) Division of application No. 10/794,237, filed on Mar. 5, 2004.

(51) Int. Cl.
*B21D 22/00* (2006.01)

(52) U.S. Cl. ..... 72/348; 72/379.4; 72/715; 413/76; 220/606; 220/609

(58) Field of Classification Search ..... 72/347, 72/348, 349, 379.4, 715; 220/604, 606, 608, 220/609, 623, 624; 413/60, 76
See application file for complete search history.

(56) References Cited

U.S. PATENT DOCUMENTS

| | | | | |
|---|---|---|---|---|
| 3,693,828 | A | 9/1972 | Kneusel et al. | 220/66 |
| 4,134,354 | A | 1/1979 | Cvacho et al. | 72/348 |
| 4,179,909 | A | 12/1979 | Maeder | 72/45 |
| 4,289,014 | A | 9/1981 | Maeder et al. | 72/348 |
| 4,372,143 | A | 2/1983 | Elert et al. | 72/343 |
| 4,412,627 | A | 11/1983 | Houghton et al. | 220/66 |
| 4,620,434 | A | 11/1986 | Pulciano et al. | 72/347 |
| 4,685,582 | A | 8/1987 | Pulcianai et al. | 220/66 |
| 4,768,672 | A | 9/1988 | Pulciani et al. | 220/66 |
| 4,919,294 | A | 4/1990 | Kawamoto et al. | 220/70 |
| 5,105,973 | A | 4/1992 | Jentzsch et al. | 220/606 |
| 5,111,679 | A * | 5/1992 | Kobayashi et al. | 72/348 |
| 5,222,385 | A | 6/1993 | Halasz et al. | 72/117 |
| 5,351,852 | A | 10/1994 | Trageser et al. | 220/606 |

(Continued)

FOREIGN PATENT DOCUMENTS

EP 0450651 A1 10/1991

(Continued)

OTHER PUBLICATIONS

International Search Report for PCT/US2005/006642 application of Rexam Beverage Can Company, dated May 13, 2005.

(Continued)

*Primary Examiner*—Edward Tolan
(74) *Attorney, Agent, or Firm*—McDonnell Boehnen Hulbert & Berghoff LLP

(57) ABSTRACT

Drawn and ironed aluminum can bodies are made from aluminum having a gauge thickness of 0.01075 inches or less, in which the bottom profile meets customer requirements for bottom performance in terms of buckle, drop and growth, without requiring the bottom profile to be reformed in a separate bottom profile reforming step.

4 Claims, 4 Drawing Sheets

U.S. PATENT DOCUMENTS

| | | | | | |
|---|---|---|---|---|---|
| 5,355,709 | A | * | 10/1994 | Bauder et al. | 72/356 |
| 5,524,468 | A | | 6/1996 | Jentzsch et al. | 72/117 |
| 5,697,242 | A | | 12/1997 | Halasz et al. | 72/117 |
| 5,730,314 | A | | 3/1998 | Wiemann et al. | 220/609 |
| 5,836,473 | A | | 11/1998 | Jentzsch et al. | 220/606 |
| 5,934,127 | A | | 8/1999 | Ihly | 72/110 |
| 5,984,604 | A | | 11/1999 | McMahon | 413/69 |
| 6,077,554 | A | * | 6/2000 | Wiemann et al. | 426/397 |
| 6,079,244 | A | | 6/2000 | Robinson et al. | 72/61 |
| 6,098,832 | A | | 8/2000 | Jentzsch et al. | 220/606 |
| 6,131,761 | A | | 10/2000 | Cheng et al. | 220/623 |
| 6,132,155 | A | | 10/2000 | Gouliard et al. | 413/69 |
| 6,293,421 | B1 | | 9/2001 | Jentzsch et al. | 220/606 |
| 6,293,422 | B1 | | 9/2001 | Jentzsch et al. | 220/608 |
| 6,296,139 | B1 | | 10/2001 | Hanafusa et al. | 220/609 |
| 6,305,210 | B1 | | 10/2001 | Saunders et al. | 72/348 |
| 6,640,149 | B1 | | 10/2003 | Nardini et al. | 700/117 |
| 2001/0009107 | A1 | * | 7/2001 | Cheng et al. | 72/348 |

FOREIGN PATENT DOCUMENTS

| | | | |
|---|---|---|---|
| EP | 1127795 | A2 | 8/2001 |
| JP | 04344842 | | 12/1992 |

OTHER PUBLICATIONS

Written Opinion of the International Searching Authority for PCT /US2005/006642 application of Rexam Beverage Can Company, dated May 13, 2005.

International Preliminary Report on Patentability, PCT/US2005/006642, application of Rexam Beverage Can Company, dated Mar. 13, 2006.

* cited by examiner

BOTTOM PROFILE FOR DRAWN AND IRONED CAN BODY

This application is a divisional of Ser. No. 10/794,237 filed Mar. 5, 2004.

BACKGROUND OF THE INVENTION

A. Field of the Invention

This invention relates to the can manufacturing art, and more particularly to a novel construction and arrangement of the bottom portion of a drawn and ironed can body and method for making such a can body.

B. Description of Related Art

It is well known to draw and iron a sheet metal blank to make a thin-walled can body for packaging beverages, such as beer, fruit juice or carbonated beverages. In a typical manufacturing method for making a drawn and ironed can body, a circular disk or blank is cut from a sheet of light gauge metal (such as aluminum). The blank is then drawn into a shallow cup using a cup forming equipment. The cup is then transferred to a body maker where the can shape is formed. The body maker re-draws and irons the sidewall of the cup to approximately the desired height, and forms dome and other features on the bottom of the can. The dome and other feature on the bottom edge of the can are referred to herein as the "bottom profile" of a drawn and ironed can body.

Can body manufacturing techniques are described in the patent literature. Representative patents include U.S. Pat. Nos. 6,305,210; 6,132,155; 6,079,244; 5,984,604, and 5,934,127, the contents of which are incorporated by reference herein. Domer assemblies for drawing and ironing machines are described in U.S. Pat. Nos. 4,179,909; 4,620,434; 4,298,014, all assigned to National Can Corporation, the contents of which are incorporated by reference herein.

In current practice, after the can is formed in the body maker, the can is sent to a separate necking and flanging station, where the neck and flange features are formed on the upper regions of the can. The flange is used as an attachment feature for permitting the lid for the can, known as an "end" in the art, to be seamed to the can. The last station in the necker-flanger is a reformer station. This station includes a set of tools for reforming the bottom profile of the can in order to increase the strength of the bottom profile. U.S. Pat. Nos. 5,222,385 and 5,697,242, both assigned to American National Can Co., describe a can body reforming apparatus and methods for reforming can bodies to increase the strength of the bottom profile. Ihly, U.S. Pat. No. 5,934,127 also describes can bottom reforming apparatus. Other patents of interest include Gouillard, U.S. Pat. No. 6,132,155 and Saunders et al., U.S. Pat. No. 6,305,210. After necking, flanging and bottom reforming, the top edge of the can is trimmed.

Long ago, when cans were made from a relatively heavy gauge aluminum, a bottom profile could be formed by the body maker that did not require a separate reforming operation in order to increase the strength of the bottom of the can. The separate reforming operation was not necessary due to the relatively thick aluminum gauge material providing the required strength. However, under current practice, aluminum stock used for drawn and ironed beverage cans is of a much thinner gauge than it used to be, in order to reduce the amount of material used to make a can. Consequently, it is much more difficult to provide a can bottom profile resulting from the shaping performed by the body maker that possesses the strength required to meet customer requirements for bottom performance. Thus, in accordance with the present practice of the assignee of this invention, after formation of the can by the body maker, the separate bottom reforming step is performed to further form or shape the bottom of the can in order to increase the strength of the bottom profile and allow it to meet customer requirements in terms of can bottom performance.

The bottom performance of a drawn and ironed can body is typically characterized by three independent and distinct criteria: can growth, drop, and buckle. Can growth refers to a deformation of the can bottom due to the pressurized contents of the can causing the bottom of the can to extend further in the axial direction. The can is pressurized to 90 PSI, the pressure is removed, and the growth g is measured. The phenomenon is shown in FIG. 1. The can bottom profile prior to pressurization is shown in dashed lines, the bottom profile after pressurization is shown in solid lines. The bottom profile 10 includes a nose portion 12 which defines a circumferential stand or base on which the can sits. The bottom profile 10' after growth shows the nose portion 12'. Growth occurs by an unrolling action of the nose 12, wherein the material forming the nose moves away from the region of the dome 14. Growth resistance is thus a measure of the stiffness of the bottom profile—how much pressure can the can withstand before the nose 12 unrolls, and the amount g of can growth at a given pressure. As is known in the art, the tighter the radius of the nose 12 is, the more pressure required to "unroll" the nose and incur can growth. Hence, bottom profile reforming typically involves reforming the nose so as to decrease the nose radius to improve can growth characteristics.

Drop refers to a measurement of the height at which a can, filled with water and pressurized with nitrogen to 60 pounds per square inch, is dropped and lands square on a steel platform, which results in a reversal (either whole or partial) of the dome in the bottom of the can, such that the can will no longer stand without tipping. The drop height starts at three inches and increases one inch until the failure criteria is reached. Typically, 10 or more cans are tested and the average and standard deviation are reported as results. During a drop test, the sudden dynamic load of the liquid increases the pressure on the dome. The result is shown in FIG. 2. The figure shows the dome 14' (solid line) just prior to the dome reversal. The dome at 14' in the Figure is not the final shape of the dome at failure, as in the final configuration the dome completely reverses, as shown. The following results are observed, as shown in FIG. 2: The nose is restrained from unrolling (as shown in FIG. 1) by the steel platform; the inner leg or chime 16 rotates outwardly and results in a negative angle; a more shallow dome results; and the dynamic load of the liquid in the can causes a local collapse of the dome 14. The dome becoming shallower does not constitute a failure; the inability to stand a can without tipping is considered a failure.

Buckle refers to the internal pressure limit (e.g., 100 PSI) at which point the dome in the bottom of the can reverses. Like the growth issue described previously, dome reversal involves a dynamic "rolling" at the nose of the can. See FIG. 3. Dome reversal occurs when there is no more leg material available to the roll (nose), additionally the leg angle tilts inwardly by a considerable margin (positive angle). A design goals for increasing buckle is to provide a deeper dome depth, reforming to tilt the leg angle outward (provide a negative chime angle) and provide a larger nose radius and dome corner radius to provide more material for the dynamic rolling of the nose.

As is known in the art, and as indicated by the above discussion, changing the parameters or values of the various features of the can bottom profile (dome radius of curvature, stand diameter, nose radius, chime angle, etc.) tend to effect the ability of the can to meet the above-referenced bottom performance criteria. However, a change in a particular value in the can bottom profile may result in a positive improvement in one criteria (such as minimize can growth), but at the same time negatively affect one or more of the other parameters (such as, for example, lower the buckle limit and lower the drop limit). Complicating the situation is the fact that can bodies are made from a very thin gauge of aluminum material, and as the material becomes thinner, it becomes increasingly difficult to design the can body that meets all the bottom performance criteria.

Further considerations of the design of the bottom of a can are reduction in bottom wrinkling and reduction in bottom thinning. These considerations, in addition to the previously described goals of increasing bottom performance in terms of buckle, drop and growth, typically oppose each other. In other words, the steps a designer may take to improve can bottom performance may actual work against reducing bottom wrinkling or bottom thinning.

Accordingly, there has been a need in the art for a new and improved can body which optimizes the various can bottom design parameters such that it not only meets the bottom performance criteria required by the industry, using current gauge material for the can body, but allows the can body to be formed without requiring a separate reforming process to strengthen the bottom profile. This need is particularly strong in today's environment since the can body reforming process can represent the most consistent bottleneck in high-speed can manufacturing operations. It has been the experience of the inventors that the reforming tools require more frequent maintenance and are more prone to problems than the other equipment used in the process. Furthermore, to the extent that the bottom reformer can be completely eliminated, it represents a savings in capital expense, since the equipment does not have to be purchased, and savings of labor and energy consumption.

An objective of the present invention is to provide a bottom profile design for a thin walled drawn and ironed can body made from 0.01075 inch gauge material or thinner which does not require a separate reforming step in order for the can body to meet customer (industry) strength requirements for bottom performance, passes a drop test of at least 5½ inches, and has acceptable bottom wrinkling and bottom thinning characteristics.

SUMMARY OF THE INVENTION

We have described herein a beverage can having a can body made from aluminum having a gauge thickness of 0.01075 inches or less, the can body having a bottom profile, wherein the following two properties are observed by virtue of the selection of values for the bottom profile:

(1) the forming of said can body is completed without performing a step of reforming of the bottom profile to increase the strength of the bottom profile to meet customer requirements for can growth, drop and buckle, and (2) the can passes a drop test of at least 5½ inches.

In one embodiment, the bottom profile comprises a dome corner radius R2 connecting a dome in the bottom profile to a chime in the bottom profile, and wherein R2 is greater than 0.080 inches, and in a particular embodiment is between 0.080 and 0.15 inches. In another embodiment, the bottom profile further comprises a nose portion having a radius R3, and wherein R3 is at least 0.048 inches.

In another embodiment, the bottom profile comprises a dome and a dome corner radius R2. The dome tangentially intersects the dome corner radius R2 at a point R. The included angle α between lines L1 and L2 is between about 45 degrees and about 55 degrees, where line L1 extends from the center of curvature of the dome corner radius R2 in a direction perpendicular to a longitudinal axis of the can body, and line L2 extends from the center of curvature of the dome corner radius and intersects the point R.

BRIEF DESCRIPTION OF THE DRAWINGS

A presently preferred embodiment of the invention is described below in conjunction with the drawings, in which like reference numerals refer to like elements in the various views, and in which.

DETAILED DESCRIPTION OF THE PREFERRED EMBODIMENTS OF THE INVENTION

Figure 1:
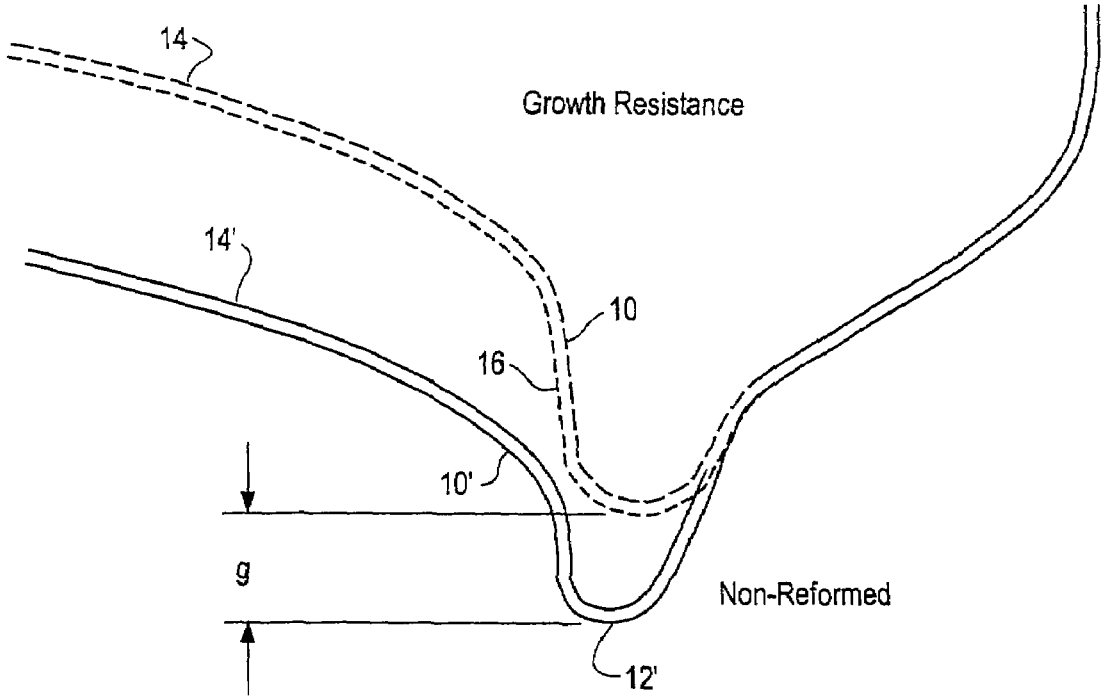
FIG. 1 illustrates the growth phenomenon in can bottom profiles.
Figure 2:
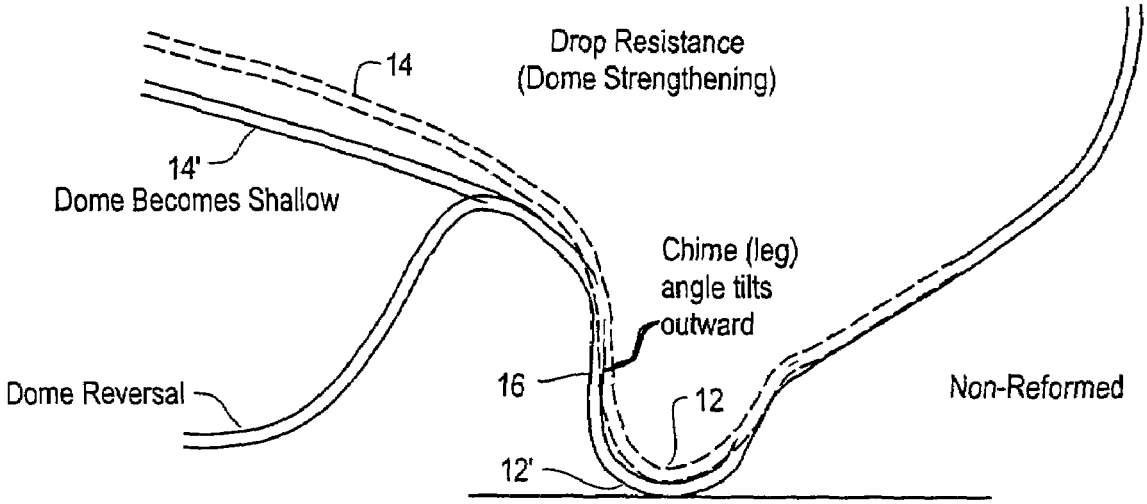
FIG. 2 illustrates the drop deformation in can bottom profiles.
Figure 3:
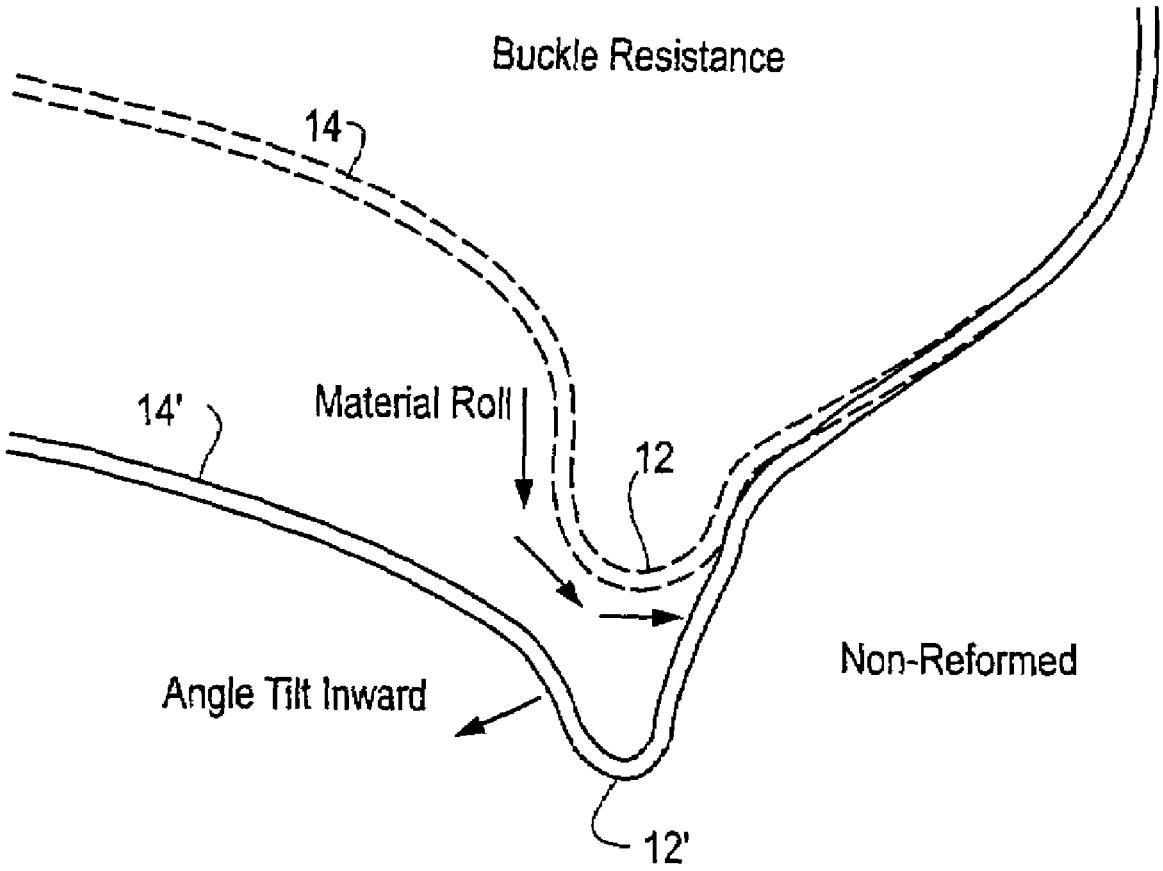
FIG. 3 illustrates the buckle phenomenon in can bottom profiles.

In a first aspect, an improved bottom profile for one-piece drawn and ironed beverage can body is provided. The can body is made from aluminum having a starting gauge thickness, in the preferred embodiment, of approximately 0.01075 inches, and meets all specified performance requirements for drop, growth and buckle, will be explained further below. The improved bottom profile provides for improvements in bottom performance, reduction in bottom wrinkling, and reduction in bottom thinning. The improved bottom profile can be formed by a domer assembly in a standard drawing and ironing machine, without requiring any subsequent bottom profile reforming operation or apparatus to increase the strength of the bottom profile. The presently preferred embodiments balance all the various bottom profile parameters with 0.01075 inch gauge aluminum material and meets can bottom performance criteria without requiring the use of separate bottom reforming. Furthermore, testing has indicated that that further down gauging of the aluminum below 0.01075 inches, and to 0.01060 is possible without requiring reforming. Some modification may be needed to the bottom profile from the disclosed embodiments to meet drop requirements with lighter gauge materials, but from the present disclosure such modifications can be achieved without undue experimentation by persons skilled in the art.

In one specific embodiment, and improved bottom profile for one-piece drawn and ironed beverage can body is provided. The can body is made from aluminum having a gauge thickness of 0.01075 inches or less. The bottom profile has a stand portion having an inner nose radius and an outer nose radius, a chime adjacent to the stand portion and having a chime length, a dome portion having two radii of curvature R1*a* and R1*b*, and a dome corner radius R2 joining the chime to the dome radius Rib and having a dome corner radius of curvature. The inner nose radius and outer nose radius, chime length, dome radius (radii) of curvature and dome corner radius are all selected relative to each other so as result in the can body meeting customer requirements for can bottom performance in terms of buckle, drop and growth. In a particular embodiment, the dome radius R1*a* is greater than 1.5 inches and radius Rib is between 0.2 and 1.0 inches, and radius R2 is between 0.060 and 0.120 inches.

Furthermore, the can body including bottom profile are formed in a body former, without the use of a further bottom profile reforming process or apparatus to meet the objectives for can body performance.

In a preferred embodiment, the dome tangentially intersects the dome corner radius at a point R (shown in the drawings), and wherein the included angle α ("dome angle" herein) between lines L1 and L2 (also shown in FIG. 5) is between about 45 and 55 degrees and more preferably between 47½ degrees and about 52½ degrees, where line L1 extends from the center of curvature of the dome corner radius in a direction perpendicular to the longitudinal axis of the can body, and line L2 extends from the center of curvature of the dome corner radius and intersects the point R. The dome corner radius also tangentially intersects the adjacent portion of the bottom profile, i.e., the chime leg.

In a second aspect, a method is provided of manufacturing a can body from an aluminum blank having a gauge thickness of 0.01075 inches or less, comprising the steps of forming a cup from said blank and drawing and ironing the cup in a body former to form a can body, wherein the can body includes a bottom profile. The body former has tooling to form the following features in the bottom profile: a stand portion having an inner nose radius and an outer nose radius, a chime adjacent to the stand portion and having a chime length, a dome portion having at least one dome radius of curvature, and a dome corner radius joining the chime to the dome and having a dome corner radius of curvature. The dimensions of the tooling forming the inner nose radius and outer nose radius, chime length, dome radius (radii) of curvature and dome corner radius are selected relative to each other so as result in the can body meeting customer requirements for can bottom performance in terms of buckle, drop and growth and wherein subsequent to the drawing and ironing step no further bottom profile reforming process or apparatus is applied to the can body to provide further strengthening of the bottom profile of the can body in order to meet the requirements for can bottom performance. The method continues with a step of necking the can body.

In a particular embodiment, a drawn and ironed can body is provided. The can body includes a generally cylindrical side wall, a bottom portion integral with the side wall and closing off one end of the can body, the bottom portion having a profile comprising a stand portion having an inner nose radius and an outer nose radius, a chime adjacent to the stand portion and having a chime length, a dome portion having at least one dome radius of curvature, and a dome corner radius joining the chime to the dome and having a dome corner radius of curvature. The dome intersects the dome corner radius at a point R, and wherein the included angle α between lines L1 and L2 is between about 47½ degrees and about 52½ degrees, where line L1 extends from the center of curvature of the dome corner radius in a direction perpendicular to the longitudinal axis of said can body, and line L2 extends from the center of curvature of the dome corner radius and intersects the point R. The dome corner radius is between 0.06 and 0.12 inches, and the chime length is between 0.060 and 0.080 inches, the inner and outer nose radii are between 0.050 and about 0.060 inches.

Figure 4:
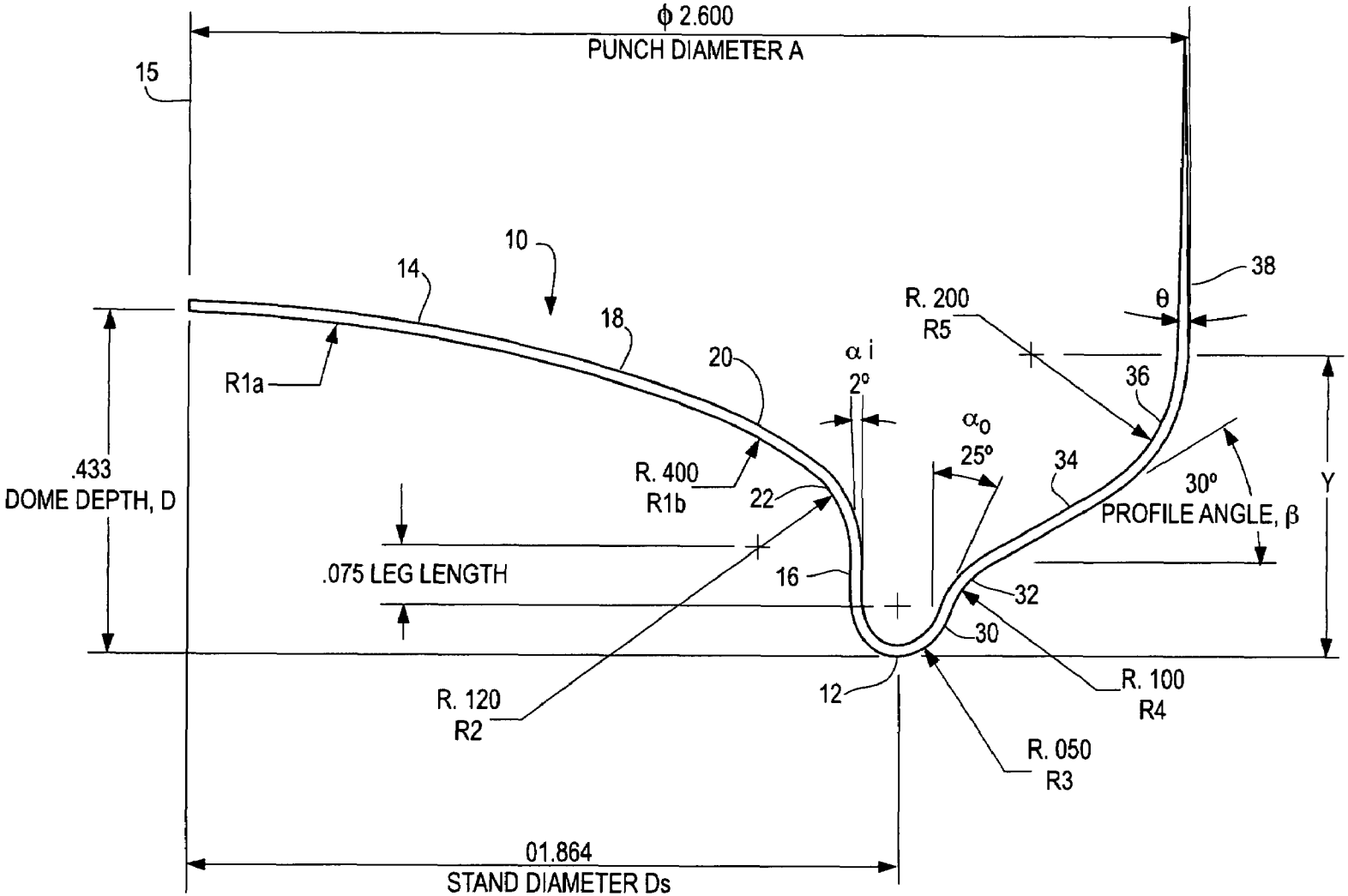
FIG. 4 is a cross-sectional view of a can body showing a bottom profile in accordance with the invention.

The bottom profile in accordance with a preferred embodiment is shown in FIG. 4 and now will be described in detail. FIG. 4 is a cross-sectional view of a can bottom profile 10. The can body is symmetrical about a longitudinal axis 15. The dome portion 14 includes two portions with different radii of curvature, a central or inner portion 18 having a radius R1*a*, and a peripheral or outer portion 20 having a radius R1*b*. The outer portion 20 connects with the chime or leg 16 via a dome corner radius 22 having a radius R2. The dome corner radius 22 is tangential with both the peripheral dome portion 20 and the chime 16. The chime 16 is inclined at a positive angle αi, referred to herein as the chime angle. The chime or leg 16 leads to the nose or stand portion 12. The nose 12 may have one continuous radius for both the inner and outer portions 26 and 28 (see FIG. 5), or, alternatively have separate radii, shown as the inner and outer nose radii R3*i* and R3*o* in FIG. 5.

The bottom profile 10 further includes an outer chime 30, arranged at an outer chime angle αo, a profile radius 32 having a radius of curvature R4, a profile portion 34 arranged at a profile angle β, a punch radius portion 36 having a radius R5, and a transition region 38 where the material is progressively thinned to form the thin sidewall of the can body. The transition region 38 is formed at a lower transition angle θ relative to the longitudinal axis 15.

To manufacture the can body and profile, a cup is made from a circular blank of aluminum in a cupper apparatus and the cup is sent to a draw and iron body maker. A punch is inserted in the cup and the cup is drawn and ironed in the body maker. Domer tooling at the base of the body maker forms the bottom profile shown in FIG. 4. The manufacturing process is conventional and known in the art, and described in the patents cited previously. In the illustrated embodiment, the punch has a punch diameter A which fits closely inside the body of the cup during the re-drawing and ironing process. The domer tooling has a tooling clearance x relative to the punch nose tooling which sets the inner chime angle to a positive value to allow the can body to be stripped from the body maker.

In order to meet customer requirements for can bottom performance (buckle, drop and growth) and meet targets for thinning and wrinkling, careful study of the performance elements, and the contributions of the various parameters to these elements, was performed using a finite element analysis modeling of the can body bottom profile. From this study, and subsequent experiments on actual cans made with the profile, we have determined that it is possible to make a can body from approximately 0.01075 inch gauge aluminum which meets customer requirements without using a subsequent bottom profile reforming process or apparatus. These standards for bottom performance are currently 0.050 maximum growth g (FIG. 1), 90 PSI buckle strength, and a 5.5 inch can drop height.

In the course of our study, we have found that fine tuning of following parameters relative to each other were particularly significant in meeting our objective: the nose radius (both inner nose radius and outer nose radius), chime length dome radii of curvature, dome angle α, and dome corner radius.

As to the dome radii, we have chosen a dome with two radii. The central portion with radius R1*a* can be made with a relatively large radius. The peripheral portion, with radius R1*b*, has a substantially less radius in order to place the stand or nose at the correct location. This permits us to use a relatively large dome corner radius R2, without significantly reducing the drop characteristics, contrary to conventional wisdom. In fact, increased buckle and drop values are observed at the same time with the preferred embodiment. We are able to use a larger dome corner radius R2 given our selection of relatively large central dome radius R1*a*, i.e., one with a radius of curvature greater than 1.5 inches, and the relatively small peripheral dome radius, i.e., one with a radius of curvature of between 0.2 and 1.0 inches. It may be possible to substitute a dome with three or more radii of curvature, or use a dome with a constantly varying radius of curvature, in less preferred embodiments.

Figure 5:
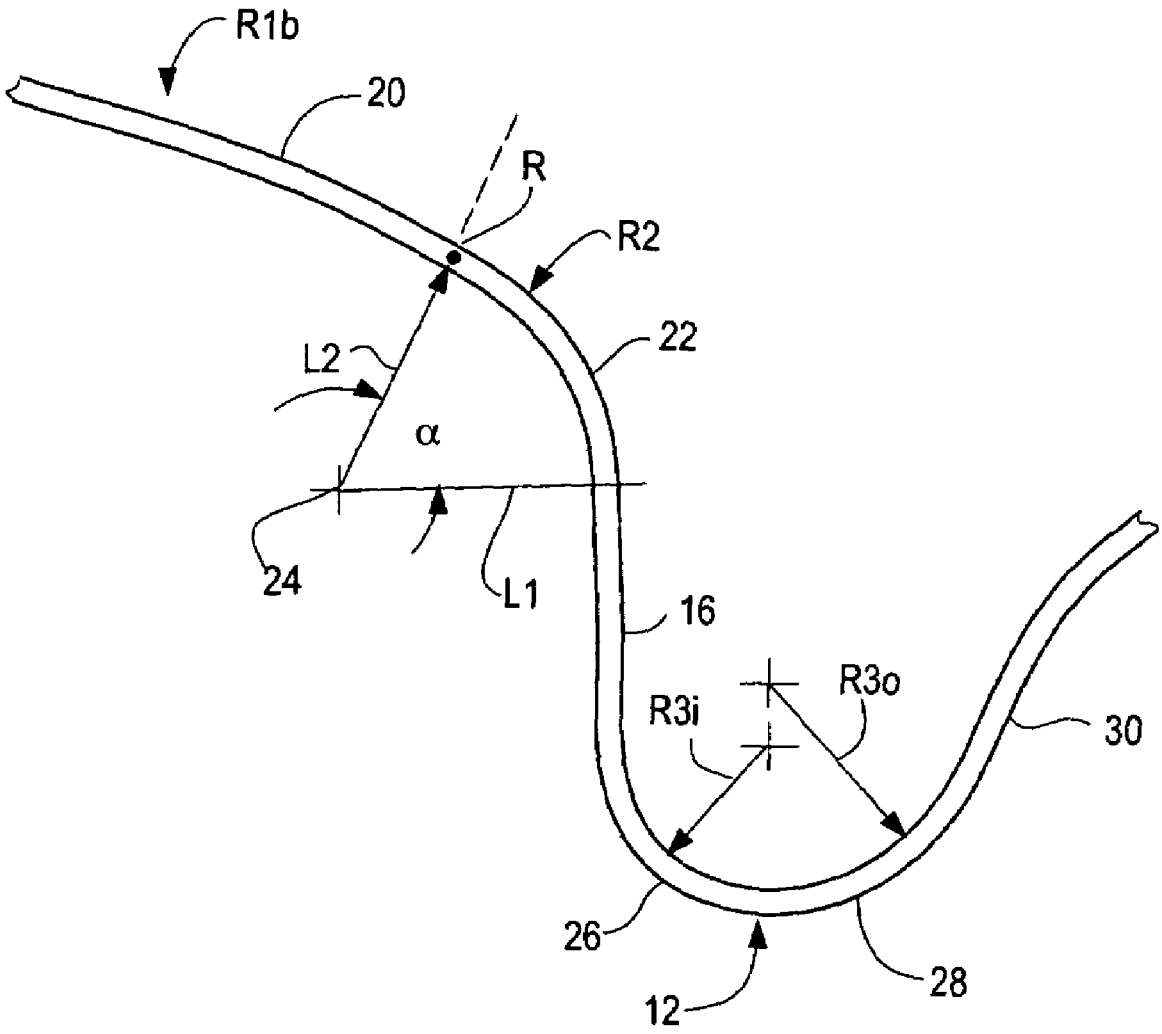
FIG. 5 is a detailed view of a portion of the bottom profile in the region of the dome corner radius and chime, illustrating the dome angle α defined between lines L1 and L2.

In a preferred embodiment, and as shown in FIG. 5, the dome 14 (i.e., peripheral dome radius 20) tangentially intersects the dome corner radius 22 at a point R (shown in the FIG. 5). The point R, and the included angle (dome angle α) between lines L1 and L2, are carefully chosen to optimize buckle, drop and growth characteristics. The included angle α between lines L1 and L2 (shown in FIG. 5) is preferably selected to be between about 45 and 55 degrees, and more preferably between about 47½ degrees and about 52½ degrees. L1 is defined as a line that extends from the center of curvature 24 of the dome corner radius 22 in a direction perpendicular to the longitudinal axis 15 of the can body (shown in FIG. 4), and line L2 extends from the center of curvature 24 of the dome corner radius 22 and intersects the point R.

Preferred ranges and a presently preferred value for a specific 12 oz. beverage can embodiment with the can bottom profile of FIGS. 4 and 5 are set forth in Table 1.

TABLE 1

| | Variable | Typical Range (inches) | Value (inches) |
|---|---|---|---|
| A | punch diameter | 2.5980-2.6030 | 2.600 |
| D | dome depth | 0.420-0.435 | 0.433 |
| R1a | dome radius (central) | 1.600-2 | 1.905 |
| R1b | dome radius (peripheral) | 0.200-1 | 0.400 |
| R2 | dome corner radius | 0.060-0.15 | 0.120 |
| R3i | inner nose radius | 0.040-0.060 | 0.050 |
| R3o | outer nose radius | 0.040-0.060 | 0.050 |
| Ds | stand diameter | 1.864-1.904 | 1.864 |
| Y | profile height | .360-.380 | 0.378 |
| L | chime length | 0.060-0.080 | 0.075 |
| αi | chime angle | 2-5 degrees | 2 degrees |
| | chime tooling clearance | 0.010-0.015 | 0.015 |
| R4 | profile radius | 0.089-.100 | 0.100 |
| R5 | punch radius | 0.180-0.200 | 0.200 |
| ao | outer chime angle | 20-25 degrees | 25° 0' |
| β | profile angle | 28-35 degrees | 30° 0' |
| θ | lower transition angle | 1-1.5 degrees | 1.075° |
| α | dome angle | 45-55 degrees | 50 degrees |

Table 2 sets for the various design parameters, describes their function, and explains the trends in variation of values for the parameters.

TABLE 2

| Parameter | Function | Trend |
|---|---|---|
| A | DEFINES THE BODY DIAMETER OF THE CAN | AS DIAMETER INCREASES: CAPACITY INCREASES |
| D | PROVIDE BUCKLE RESISTANCE | AS DOME DEPTH INCREASES: BUCKLE RESISTANCE INCREASES |
| R1a | PROVIDE DOME CURVATURE TO RESIST BUCKLE AND DROP FORCES | AS RADIUS INCREASES: DROP RESISTANCE DECREASES |
| R1b | PROVIDE DOME CURVATURE TO RESIST BUCKLE AND DROP FORCES (ADDED SPECIFICALLY TO IMPROVE DROP) | AS RADIUS INCREASES: DROP RESISTANCE DECREASES |
| R2 | BLEND DOME PROFILE INTO CHIME AREA | AS RADIUS INCREASES: BUCKLE RESISTANCE INCREASES, DROP DECREASES |
| R3i | STRENGTHEN BOTTOM AND BLEND IN WITH RIDING SURFACE | AS RADIUS INCREASES: BUCKLE RESISTANCE INCREASES, GROWTH VALUE INCREASES, THINNING DECREASES |
| R3o | STRENGTHEN BOTTOM AND BLEND IN WITH RIDING SURFACE | AS RADIUS INCREASES: GROWTH VALUE INCREASES, THINNING DECREASES |
| Ds | TYPICALLY DETERMINES THE COMPATIBLE END SIZE FOR STACKING | AS DIAMETER INCREASES: BUCKLE DECREASES, WRINKING DECREASES |
| profile height (Y) | EFFECTS STACKING, BOTTOM PERFORMANCE AND FORMABILITY | AS Y INCREASES: PERFORMANCE INCREASES, WRINKLING INCREASES |
| Chime L | HAS A DIRECT INFLUENCE ON BOTTOM PERFORMANCE | AS LEG INCREASES: BUCKLE INCREASES, DROP INCREASES, TYPICALLY THINNING INCREASES |
| ai | ADDS TO BUCKLE RESISTANCE | AS ANGLE INCREASES: BUCKLE DECREASES, THINNING DECREASES |
| tooling clearance | SETS THE INNER CHIME ANGLE | AS CLEARANCE INCREASES: BUCKLE DECREASES, THINNING DECREASES |
| R4 | MAKES THE PROFILE STACKABLE | — |
| R5 | BLEND TRANSITION TO BOTTOM | AS RADIUS INCREASES: BUCKLE RESISTANCE DECREASES, GROWTH |

TABLE 2-continued

| Parameter | Function | Trend |
|---|---|---|
| | | VALUE INCREASES, WRINKLING DECREASES |
| αo | LOCATE STACKING RADIUS ON OUTER PROFILE | |
| β | PROVIDES BOTTOM STRENGTH TO A PROFILE | AS ANGLE INCREASES: BUCKLE INCREASES, GROWTH VALUE DECREASES, WRINKLING INCREASES |
| θ | PROVIDES A TRANSITION FOR MATERIAL THICKNESS FROM STARTING GAUGE TO MIDWALL | AS ANGLE INCREASES: CAN WEIGHT DECREASES, AXIAL LOAD DECREASES, HEEL DENTS INCREASE |
| Dome angle α | PROVIDES DROP PERFORMANCE | AS ANGLE INCREASES: DROP RESISTANCE DECREASES |

Further finite element analysis experiments were conducted to determine the effect of certain parameters in producing wrinkles and thickness reduction (thinning) in the bottom profile. It was determined that increasing the Y dimension (FIG. 4) produced a significant increase in the occurrence of wrinkles, and increasing the punch radius R5 had a significant effect on reducing wrinkling. Increasing the nose radius R3 had a relatively significant effect in lowering the thickness reduction.

While the invention has been tested and found to work with starting gauges of 0.01075 inches, further testing has shown satisfactory results for growth, buckle and drop, without reforming of the bottom profile at a starting gauge of 0.01060 inches. It is predicted that satisfactory results can be obtained for gauges as thin as 0.01040 inches by persons skilled in the art without undue experimentation, although some variation of the parameters from the presently preferred embodiment and testing can be expected. Further down gauging of the metal is possible below 0.01040 inches, although good results without bottom reforming may require a material change and use of a more advanced aluminum alloy than those commonly used for beverage cans today.

Variations from the specifics of the preferred embodiment are contemplated without departure from the scope of the invention.

We claim:

1. A method of manufacturing a can body from an aluminum blank having a gauge thickness of 0.01075 inches or less, comprising the steps of:

forming a cup from said blank;

drawing and ironing said cup in a body former to form a can body, wherein said can body formed in said body former includes a bottom profile, said body former having tooling to form the following features in said bottom profile: a stand portion having an inner nose radius and an outer nose radius, a chime adjacent to said stand portion and having a chime length, a dome portion, and a dome corner radius R2 joining said chime to said dome and having a dome corner radius of curvature; wherein said dome portion comprises radii R1*a* and R1*b*, R1*a* being greater than 1.5 inches and less than or equal to about 2.0 inches and radius R1*b* between 0.2 and 1.0 inches, and radius R2 being between 0.060 and 0.120 inches, and necking said can body;

wherein the dimensions of said tooling forming said inner nose radius and outer nose radius, chime length, dome radii of curvature and dome corner radius are selected relative to each other so as to result in said can body meeting customer requirements for can bottom performance in terms of buckle, drop and growth and wherein subsequent to said drawing and ironing step no further bottom profile reforming process or apparatus is applied to said can body to provide further strengthening of the bottom profile of the can body in order to meet said requirements for can bottom performance.

2. The method of claim 1, wherein said tooling is formed in a manner wherein said dome tangentially intersects said dome corner radius at a point R, and wherein the included angle α between lines L1 and L2 is between about 45 degrees and about 55 degrees, where line L1 extends from the center of curvature of the dome corner radius in a direction perpendicular to the longitudinal axis of said can body, and line L2 extends from the center of curvature of the dome corner radius and intersects said point R.

3. The method of claim 1, wherein said tooling is formed such that said chime length is between 0.060 and 0.080 inches.

4. The method of claim 1, wherein said tooling is constructed such that said inner and outer nose radii are between 0.045 and about 0.060 inches.

* * * * *

UNITED STATES PATENT AND TRADEMARK OFFICE

CERTIFICATE OF CORRECTION

PATENT NO. : 7,395,686 B2
APPLICATION NO. : 11/890107
DATED : July 8, 2008
INVENTOR(S) : Lillian Dervy et al.

It is certified that error appears in the above-identified patent and that said Letters Patent is hereby corrected as shown below:

On the title page, item (73) Assignee, the name of the Assignee should read: Rexam Beverage Can Company.

Signed and Sealed this

Second Day of September, 2008

JON W. DUDAS
*Director of the United States Patent and Trademark Office*